United States Patent [19]

Haas

[11] 4,347,440

[45] Aug. 31, 1982

[54] FILTER ARRANGEMENT FOR AN X-RAY APPARATUS

[75] Inventor: Werner Haas, Lafayette, Calif.

[73] Assignee: Siemens Medical Laboratories, Inc., Walnut Creek, Calif.

[21] Appl. No.: 166,805

[22] Filed: Jul. 9, 1980

[51] Int. Cl.[3] ..... G21F 3/02; G21K 3/00

[52] U.S. Cl. ..... 378/156; 250/505.1

[58] Field of Search ..... 250/510, 505

[56] References Cited

U.S. PATENT DOCUMENTS

| | | | |
|---|---|---|---|
| 2,405,444 | 8/1946 | Moreau et al. | 250/510 |
| 2,506,342 | 5/1950 | Burke . | |
| 3,248,547 | 4/1966 | Van de Geijn . | |
| 3,631,249 | 12/1971 | Friede et al. | 250/510 |
| 3,748,487 | 7/1973 | Edholm et al. . | |
| 3,917,954 | 11/1975 | Boge . | |

FOREIGN PATENT DOCUMENTS

| | | | |
|---|---|---|---|
| 2053089 | 12/1972 | Fed. Rep. of Germany . | |
| 1800879 | 1/1974 | Fed. Rep. of Germany . | |
| 47-32948 | 8/1972 | Japan | 250/505 |
| 966877 | 8/1964 | United Kingdom | 250/505 |

OTHER PUBLICATIONS

Kijewski, Chin and Bjängard, "Wedge-shaped dose distributions by computer-controlled collimator motion", Medical Physics, vol. 5, No. 5, Sep./Oct. 1978, pp. 426–429.

*Primary Examiner*—Alfred E. Smith
*Assistant Examiner*—T. N. Grigsby
*Attorney, Agent, or Firm*—Spellman, Joel and Pelton

[57] ABSTRACT

The filter arrangement for an X-ray apparatus contains an X-ray source for emitting a diverging beam of X-rays and a filter plate positioned in the beam of X-rays. The beam is symmetrical with respect to a center beam axis. The filter plate which serves for attenuation of the X-rays before they impinge on a target is mounted on a pivoting axis. The pivoting axis is preferably arranged remote from and transverse to the center beam axis. By pivoting the filter plate about the pivoting axis into a selected position, a selected radiation profile can be obtained on the target. The rotatable filter plate can thus replace a plurality of wedge filters.

12 Claims, 4 Drawing Figures

FILTER ARRANGEMENT FOR AN X-RAY APPARATUS

BACKGROUND OF THE INVENTION

1. Field of the Invention

This invention relates to a filter arrangement for an X-ray apparatus having an X-ray source for directing X-rays onto a target, and having a filter plate positioned in said X-rays for attenuation of said X-rays before their impingement on the target. More particularly, this invention relates to a filter arrangement for an X-ray apparatus which is determined for radiation therapy and which directs diverging X-rays onto a human body. Still more particularly, this invention relates to a filter arrangement for a linear accelerator.

2. Description of the Prior Art

In many X-ray applications generation of X-rays is required such that the X-rays have an equally local distribution of intensity on a target. In some X-ray applications, however, it is desirable to obtain a non-uniform intensity distribution of the X-ray radiation across the target. Such a non-uniform distribution may have, for instance, an intensity maximum which decreases sharply on one side and which decreases slowly, for instance linearly, on the other side. X-rays having such an oblique local intensity distribution are used, for instance, in radiation therapy. They are applied to certain locations of disease. Deep seats of disease require a high X-ray intensity, whereas higher seats require less intensity to be applied to the body.

In some presently known X-ray apparatus, especially in linear accelerators, so-called wedge filters are used to obtain X-rays having an oblique intensity distribution. These filters are inserted into the radiation path between the X-ray source and the target. To each wedge filter belongs a predetermined energy distribution. According to the wedge angle of the filter plates, different oblique intensity distributions are obtained. In order that the doctor or radiologist can apply the X-ray intensity profile which is well adjusted to the location of the disease under treatment, he must dispose of a plurality of wedge filters having various wedge angles. Therefore, a multitude of wedge filters must be at hand and stored. The purchase of such a multitude of wedge filters can mean a large expense, and there may be difficulties in storing the wedge filters close to the X-ray apparatus. In addition, wedge filters have to be changed when another patient undergoes treatment, which procedure requires some time. Also, only wedge filters having definite, selected wedge angles are available. Wedge angles which may be necessary for irradiation and which lie between the selected wedge angles of the available wedge filters, cannot be used for treatment.

SUMMARY OF THE INVENTION

1. Objects

An object of this invention is to provide a filter arrangement for an X-ray apparatus which allows for applying various X-ray intensity profiles on a target, but which requires only one filter plate for this purpose.

Another object of this invention is to provide a filter arrangement for an X-ray apparatus which allows for a multitude of oblique intensity distribution settings, but which requires a reduced number of filter plates to be kept in stock.

It is still another object of this invention to provide a filter arrangement for an X-ray apparatus, particularly an X-ray apparatus for medical treatment such as a linear accelerator, which has the properties of a single wedge filter, the wedge angle of which may be changed and freely selected.

It is still another object of this invention to provide a filter arrangement for an X-ray apparatus the intensity profile and the absolute intensity of which can be freely set.

2. Summary of the Invention

According to this invention, a filter arrangement for an X-ray apparatus has an X-ray source for directing X-rays to a target and a filter plate positioned in the X-ray path for attenuation of the X-rays before impinging on the target. The X-rays from the X-ray source define a center beam axis.

The filter plate is pivotly mounted on a pivoting axis which is non-parallel to the center beam axis. The filter plate may be rotated about the pivoting axis to obtain a selected pivoting position. According to the selected position of the filter plate, a selected radiation profile of X-rays transmitted to the target can be obtained.

The pivoting axis is preferably positioned remote from and transverse to the center beam axis. It should be noted that the pivoting axis can be arranged as to pass preferably prependicularly through the center beam axis.

In accordance to the position and the shape of the filter plate, a more or less steep slope in the local intensity distribution will be obtained. Since pivoting will be performed preferably continuously without any steps, a multitude of oblique intensity curves of X-ray radiation can be achieved with only one filter plate.

The filter plate may be a plate having two parallel faces or may be a wedge-shaped plate. Preferably the filter plate will be made of a metal which is relatively inexpensive, such as iron or brass. However, it is also possible to use a heavy metal where a high attenuation is desired.

There can be provided a scale showing the pivoting position of the filter plate with respect to a zero position. The scale can be calibrated so that the intensity distribution which corresponds to the selected setting angle of the filter plate can be read directly.

The foregoing and other objects, features and advantages of the invention will be apparent from the following more particular description of preferred embodiments of the invention, as illustrated in the accompanying drawings.

DESCRIPTION OF THE PREFERRED EMBODIMENTS

Figure 1:
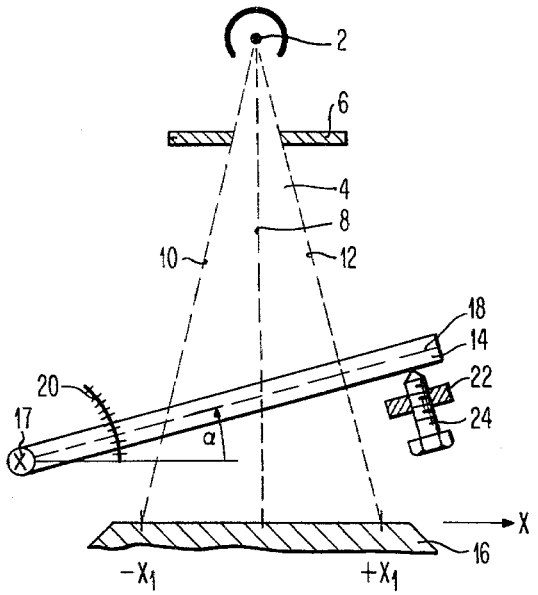
FIG. 1 is a schematic view of an X-ray apparatus incorporating a first embodiment of a filter arrangement according to the invention.

With reference to FIG. 1, an X-ray apparatus comprises an X-ray point source 2 which emits a bundle 4 of diverging X-rays. The bundle 4, which is defined or limited by a collimator 6, may be of rectangular cross-section. The center beam axis or symmetrical axis is denoted as 8, and two side beams located opposite to each other are denoted as 10 and 12, respectively. The X-rays from the point source 2 pass through a filter plate 14 and impinge on a target 16.

The X-ray apparatus illustrated in FIG. 1 is an apparatus for radiation treatment, particularly a linear accelerator, and the target 16 is a part of the human body which contains a seat of a disease. The diseased tissue is supposed to have a depth (measured from the surface of the target 16) varying along an axis x parallel to the surface. This means that the target 16 has to be exposed to an X-ray radiation the intensity of which varies along the axis x. In many treatments an oblique radiation profile, that is an X-ray intensity distribution having an intensity maximum on one side ($+x_1$) of the irradiated skin area and having a intensity slope descreasing slowly towards the other side ($-x_1$) of the irradiated area, has to be applied to the patient. In order to protect healthy tissue, it must be possible for the doctor to freely select the absolute intensity of the radiation profile.

In order to select a predetermined intensity distribution, the filter plate 14 mentioned above is provided. The filter plate 14 is a means for adjusting the X-ray energy distribution obtained on the target 16 to a radiation profile which is preselected by the doctor according to the extent, the depth and the nature of the diseased tissue. Adjustment is achieved by selective attenuation of the X-ray radiation.

The filter plate 14 is pivotly mounted on a pivoting axis 17 which is positioned remote from and transverse to the center beam axis 8. In particular, the pivoting axis 17 is arranged perpendicularly to the center beam axis 8, and the left end of the filter plate 14 is connected to the pivoting axis 17. The filter plate 14 may be of any metal, especially of a light metal or alloy. Brass or iron may be used. Iron (in contrast to brass) will be used when the X-rays have high energies and when a high attenuation is required. In the present embodiment, the filter plate 14 is a plate that has an upper and a lower face which are parallel to each other. The upper face is exposed to the bundle 4 of the X-rays. The symmetry plane of the filter plate 14 is denoted as 18. The pivoting axis 17 may preferably lie in this plane 18.

As can be seen in FIG. 1, the filter plate 14 may be rotated about the pivoting axis 17 to achieve preselected setting angles $\alpha$. The setting angle $\alpha$ is measured between the center beam axis 8 and a plane normal to the center beam axis 8. By changing the setting angle $\alpha$, the X-rays transmitted to the target 16 will experience different degrees of attenuation. They will obtain different preselected radiation profiles, as will be apparent later from FIG. 4.

A stationary scale 20 is provided for reading the swivel position or setting angle $\alpha$ of the filter plate 14. This scale 20 may be calibrated in terms of the X-ray intensity distribution on the target 16.

As can also be seen in FIG. 1, a stationary block 22 is provided with a thread in which is arranged a screw 24. The tip of the screw 24 engages the outer (right) end of the lower surface of the filter plate 14. Due to its weight, the filter plate 14 will rest in the indicated position enclosing an angle $\alpha$ with a plane perpendicular to the center beam axis 8.

Turning the screw 24 into the block 22 will raise the filter plate 14 to a larger setting angle $\alpha$. A maximum setting angle is reached when the screw 24 is completely screwed into the block 22. Reversely, turning the screw 24 back will lower the filter plate 14. Finally, the filter plate 14 will engage the block 22. In this position, a minimum setting angle is reached. Between 0° and this minimum setting angle the X-ray apparatus would generate an X-ray distribution on the surface of the target 16 that is at least fairly uniform. Above the minimum setting angle, a non-uniform intensity distribution will be observed. The minimum setting angle may be about 15° when a filter plate 14 is used that has parallel faces.

In other words, the filter plate 14 can be pivoted or rotated continuously about the pivoting axis 17 between the minimum or lowest setting angle, where the plate 14 engages the block 22, and the maximum or upper setting angle, where the screw 24 is completely screwed into the block 22. Any angle between the minimum and the maximum setting angle can be set. The screw 24 (working together with the gravity force of the filter plate 14) can be considered as a means for locking the filter plate 14 in the selected setting angle $\alpha$ between the two extreme setting angles. The two extreme setting angles determine the setting range of the filter plate 14. This range may be smaller than 45°, particularly smaller than 25°.

It should be noted that in the whole setting range the upper face of the filter plate 14 is always exposed to the X-rays coming from the X-ray source 2. In other words, in each of a multitude of selectable positions, the filter plate 14 is located in the X-ray radiation path. In the whole setting range, all X-rays emitted from the source 2 and passing the collimator 6 have to go through the filter plate 14.

Figure 2:
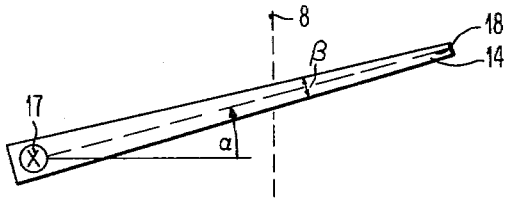
FIG. 2 is a second embodiment of a filter arrangement according to the invention.

In FIG. 2 is illustrated another embodiment of the filter plate 14. This filter plate 14 has two faces which enclose a certain wedge angle $\beta$ between each other. In other words, the filter plate 14 is a wedge-shaped plate. The wedge angle $\beta$ may be, for instance, $\beta=15°$ or more for a filter plate 14 made of a light metal. The wedge angle $\beta$ can be chosen such that the minimum setting angle (where still a uniform intensity distribution prevails) can be zero. The symmetry plane 8 of the filter plate 14 passes through the pivoting axis 17. The pivoting axis 17 is again arranged perpendicularly to the center beam axis 8. In this embodiment again the upper face of the filter plate 14 is exposed to the X-rays, when the filter plate 14 is positioned under any preselectable setting angle $\alpha$, which is between a lower setting angle and an upper setting angle.

As shown in FIG. 2, the wedge-shaped filter plate 14 has a front part, which is of smaller thickness, and a rear part, which is of larger thickness. In the embodiment of FIG. 2, the pivoting axis 17 is arranged to pass through the rear part.

Figure 3:
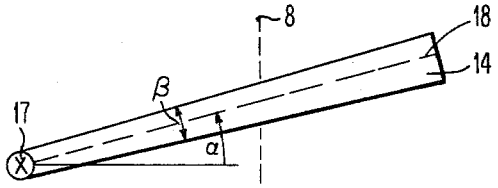
FIG. 3 is a third embodiment of a filter arrangement according to the invention.

In FIG. 3 another embodiment of the filter plate 14 is illustrated, which is also wedge-shaped. However, in this embodiment the pivoting axis 17 passes through the thinner front part of the filter plate 14. Again, the symmetry plane 18 passes through the pivoting axis 16.

The filter arrangement of FIG. 3 will generate an intensity distribution on the target 16 which is different from the intensity distribution of the filter arrangement illustrated in FIG. 2. It should be noted that in FIG. 2 the beam 10 will be more attenuated than the beam 12, whereas in FIG. 3 the beam 10 will be less attenuated than the beam 12.

There may be chosen other shapes than the parallel-face shape (see FIG. 2) or the wedge-shape (see FIGS. 2 and 3). For instance, one face of the filter plate 14 may be plane, whereas the other one is curved. The shape depends on the X-ray radiation profile which is desired. Generally speaking, the shape of the filter plate 14 should be optimized with regard to the radiation profile to be obtained on the target 16.

Figure 4:
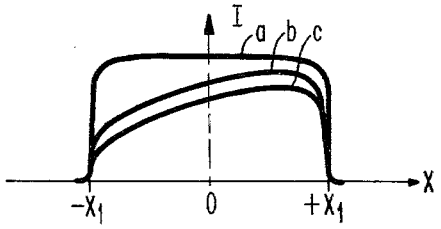
FIG. 4 is a diagram showing three intensity distributions which can be obtained by three settings of a filter plate pivotly mounted in the X-ray radiation path, according to the invention.

As schematically shown in FIG. 4, the X-ray source 2 will generate a uniform intensity distribution I(x) on the target 16 if the filter plate 14 is not present, see curve a. An approximately uniform intensity distribution will also be generated when the filter plate 14 of FIG. 1 is inserted into the radiation path and the setting angle $\alpha$ is chosen to be between $\alpha=0°$ and the minimum setting angle. Lifting the filter plate 14 beyond the minimum setting angle will create an oblique intensity distribution as can be seen from curve b in FIG. 4. Further rotating of the filter plate 14 about the pivoting axis 17 in the sense of increasing the setting angle $\alpha$ will result in a different intensity distribution, as illustrated in curve c of FIG. 4.

The reason for a uniform and a non-uniform intensity distribution is as follows (see FIG. 1): If the filter plate 14 is positioned at a setting angle $\alpha=0°$, the side beams 10 and 12 have to pass through filter plate material portions which have both the same thickness. In a regular linear accelerator, the center beam passing along the axis 8 will have to pass through a material of smaller thickness. This will result in a slightly curved, but symmetric intensity distribution, as illustrated by curve a in FIG. 4. If, however, the setting angle $\alpha$ is larger than the minimum setting angle, the left side beam 10 has to pass a longer way in the filter plate 14 than the right side beam 12. Therefore, the beam 10 will be more absorbed than the beam 12. In other words: the intensity which is passed through the filter plate 14 on the left side is smaller than the intensity transmitted on the right side. This fact is reflected by the unsymmetrical curves b and c in FIG. 4.

As mentioned above, oblique intensity distributions may be used in radiation therapy. In the tissue of the human body there can be found locations of disease (e.g. a tumor which extends into various depths) which require X-ray irradiations with X-rays having an oblique intensity distribution as shown by curves b and c in FIG. 4.

It has to be understood that FIG. 4 represents only some arbitrarily chosen intensity distributions. The actual intensity distribution of the X-rays impinging on the target 16 depends on the shape and the material of the filter plate 14 as well as one the setting angle $\alpha$. By chosing a proper setting angle $\alpha$, a preselected intensity distribution can be obtained on the surface of the target 16.

While the forms of a filter described herein constitute preferred embodiments of the invention, it is to be understood that the invention is not limited to these precise forms of assembly, and that a variety of changes may be made therein without departing from the scope of the invention.

What is claimed is:

1. A filter arrangement for an X-ray apparatus having an X-ray source for emitting X-rays, and a collimator for forming a bundle from said X-rays and for directing said bundle of X-rays onto a target, said bundle of X-rays defining a center beam axis, comprising (a) a single filter plate having a first and a second end face which are opposed to each other, said filter plate being positioned in said bundle for passing said X-rays therethrough and for attenuation of said X-rays before their impingement on said target;

(b) means for pivotally mounting said filter plate on a pivoting axis which is non-parallel to said center beam axis and for rotating said filter plate about said pivoting axis between a lower setting angle and an upper setting angle into a plurality of selected positions, wherein said two setting angles determine the setting range of said filter plate, such that in said whole setting range said first end face is always exposed to said entire bundle of X-rays, said entire bundle thereby passing through said filter plate and exiting through said second end face, thereby obtaining selected non-uniform radiation profiles of said X-rays transmitted to said target; and (c) means for locking said filter plate in a selected position within said setting range.

2. The filter arrangement according to claim 1, wherein said pivoting axis is positioned remote from said center beam axis.

3. The filter arrangement according to claim 1, wherein said pivoting axis is positioned in a plane which is perpendicular to said center beam axis.

4. The filter arrangement according to claim 1, wherein said first and second end face of said filter plate are parallel to each other.

5. The filter arrangement according to claim 1, wherein said filter plate is a wedge-shaped plate, whereby said filter plate presents different thicknesses to said bundle of X-rays emitted from said X-ray source.

6. The filter arrangement according to claim 5, wherein said wedge-shaped filter plate has a front part and a rear part, the rear part having a larger thickness than the front part, and wherein said pivoting axis is arranged at said rear part.

7. The filter arrangement according to claim 5, wherein said wedge-shaped filter plate has a front part and a rear part, the rear part having a larger thickness than the front part, and wherein said pivoting axis is arranged at said front part.

8. The filter arrangement according to claim 1, wherein a scale is provided for reading the position of said filter plate.

9. The filter arrangement according to claim 1, wherein said setting range is smaller than 45°.

10. The filter arrangement according to claim 9, wherein said setting range is smaller than 25°.

11. The filter arrangement according to claim 1, wherein said X-ray apparatus is an X-ray apparatus utilized for radiation therapy.

12. The filter arrangement according to claim 11, wherein said X-ray apparatus is a linear accelerator.

* * * * *